US007073683B1

(12) United States Patent
Quinnell et al.

(10) Patent No.: US 7,073,683 B1
(45) Date of Patent: Jul. 11, 2006

(54) APPARATUS AND METHOD FOR DETERMINING COMPLETION OF A REQUESTED TRANSACTION IN A VENDING MACHINE

(76) Inventors: Lawrence Quinnell, 2379 Newport Pl. South, Discovery Bay, CA (US) 94514; Andrew T. Fausak, 255 Dondero Way, San Jose, CA (US) 95119

( * ) Notice: Subject to any disclaimer, the term of this patent is extended or adjusted under 35 U.S.C. 154(b) by 0 days.

(21) Appl. No.: 10/740,122

(22) Filed: Dec. 17, 2003

Related U.S. Application Data

(60) Provisional application No. 60/437,769, filed on Jan. 3, 2003.

(51) Int. Cl.
*G07F 11/00* (2006.01)

(52) U.S. Cl. ..... 221/21; 700/236

(58) Field of Classification Search ..... 221/21, 221/2; 700/236, 244
See application file for complete search history.

(56) References Cited

U.S. PATENT DOCUMENTS 4,359,147 A * 11/1982 Levasseur ..... 194/200
5,417,316 A 5/1995 Harbaugh ..... 194/206
5,687,829 A * 11/1997 Churchman ..... 194/317
5,927,539 A * 7/1999 Truitt et al. ..... 221/2
6,384,402 B1 5/2002 Hair, III et al. ..... 250/223 R
6,456,067 B1 9/2002 Ward ..... 324/236
6,471,030 B1 10/2002 Neubarth et al. ..... 194/317
6,640,994 B1 * 11/2003 Chen ..... 221/2
6,708,079 B1 * 3/2004 Mason, II ..... 700/236
6,732,014 B1 * 5/2004 Whitten et al. ..... 700/244

OTHER PUBLICATIONS

Hal Philipp, Quantum Research Group Ltd., "Electrode Design for Charge Transfer Sensing", 3 pages.
Quantum Research Group Ltd., "Qprox™ QT113/QT113H, Charge-Transfer Touch Sensor", 2001, R1.10/0104, 12 pages.

* cited by examiner

*Primary Examiner*—David H. Bollinger
(74) *Attorney, Agent, or Firm*—Munsch Hardt Kopf & Harr, P.C.

(57) ABSTRACT

A sensor for detecting and signaling whether a requested product is successfully vended is placed in a vending machine. The sensor determines whether a requested product passes through a defined "vend area" within a predetermined time interval after the customer's request for the product. If the product does pass through the vend area within the time interval, a successful transaction is signaled and the sensor is reset. However, if no signal is received within the time interval, a procedure to remedy the failed transaction is executed. This procedure includes refunding the customer's money, crediting the customer's next transaction, or vending a similar product.

8 Claims, 3 Drawing Sheets

APPARATUS AND METHOD FOR DETERMINING COMPLETION OF A REQUESTED TRANSACTION IN A VENDING MACHINE

CROSS REFERENCE TO RELATED APPLICATION

This application claims priority from provisional application no. 60/437,769 filed Jan. 3, 2003.

FIELD OF THE INVENTION

This invention relates to vending machine components, particularly those that determine whether a requested product has successfully been vended.

BACKGROUND ART

Vending machines are found in many commercial establishments and other facilities such as schools, hospitals, sports stadiums, etc. They dispense drinks and food as well as other items such as stamps, toys, etc. Vending machines may accept payment in a variety of forms, including coins, paper money, credit cards, debit cards, and smart cards.

A potential drawback to using vending machines is that failed transactions, i.e., where the customer pays money and does not get the item requested, may not be remedied by the machine. In some instances, the customer may be able to cancel the transaction and receive a refund from the machine. However, if the failed transaction is due to a mechanical problem, for instance, the requested product getting jammed in the vending machine so that it doesn't drop so the customer can reach it, the customer may not be able to receive either a refund or the desired product. In these cases, the customer either has to wait for a repair service to refund the money or simply forfeit the money spent on the failed transaction. In other cases, a customer may try to jostle the machine in order to shake loose either the requested product or the money, which may result in injury either to the customer or the machine or both. Clearly, it would be desirable for vending machines to be equipped to recognize successful transactions and remedy failed transactions.

U.S. Pat. No. 6,384,402 to Hair, III et al. discloses a system to ensure a vending machine motor continues to operate either until a product is vended or a predetermined time period has elapsed. When the product is vended or dropped to where the customer can reach it, the product interrupts an optical beam in a vend space and a change in light intensity is detected, indicating the product was successfully vended. If no signal indicating the product was vended is received, the spirals holding a product will continue to be turned in an attempt to vend a product that was loaded improperly. If the spirals are rotated and a time interval has elapsed, the selector panel gives the customer the option of having his or her money refunded or to select another product.

U.S. Patent Application Publication Number 2002/0107610 to Kaehler et al. discloses a system and method for vending promotional products along with requested products. A detector within the vending machine detects when the promotional product is vended, either by scanning a code on a product or detecting an RF or magnetic tag placed on the promotional product.

The prior art discussed above relies on either the generation of electromagnetic energy or an additional tag placed on the product. It is an object of this invention to provide a sensor and method to determine whether a requested product has been successfully vended that does not require electromagnetic energy nor additional tagging of the product.

SUMMARY OF THE INVENTION

A sensor for detecting and signaling whether a requested product is successfully vended is placed in a vending machine. The sensor determines whether a requested product passes through a defined "vend area" within a predetermined time interval after the customer's request for the product. If the product does pass through the vend area within the time interval, a successful transaction is signaled and the sensor is reset. However, if no signal is received within the time interval, a procedure to remedy the failed transaction is executed. This procedure includes refunding the customer's money, crediting the customer's next transaction, or vending a similar product.

The sensor includes a detector for detecting changes or events in the vend area that are associated with the requested product being successfully vended. For instance, if a mechanical energy transmitter, producing sound or ultrasound, is placed in the vend area along with a receiver (detector), a product passing through the vend area will temporarily reduce the mechanical energy detected by the receiver. Mass-in-motion or momentum caused by the falling product contacting the sensor will also indicate the product is successfully vended. A signal indicating a successful transaction is sent and the sensor is reset.

Alternately, using a mechanical electrical switch that detects an object as it passes through the vend area, causing temporary conduction of electrical current through contacts will provide a signal indicating successful transaction.

Instead of mechanical energy, a magnetic or capacitive field may also be generated in the vend area. Changes in the field caused by the requested product passing through the field would be detected, indicating a successful transaction. Changes in ambient energy, such as light, might also be detected by a receiver as a requested product passes through the vend area.

In other embodiments of the invention, the product may be detected in the vend area by a scanner recognizing a Universal Product Code (UPC) on the product or transducers within the objects. If the scanner recognizes either a UPC or a transducer, a successful transaction is indicated. In another embodiment, a code, such as a UPC, is continuously read across the vend area. When the requested product passes through the vend area, it causes the code to be misread. This misread indicates a successful transaction.

Once a successful transaction is indicated, or the procedure to remedy a failed transaction is completed, the sensor is reset and a customer may request another product.

BEST MODE FOR CARRYING OUT THE INVENTION

Figure 1:
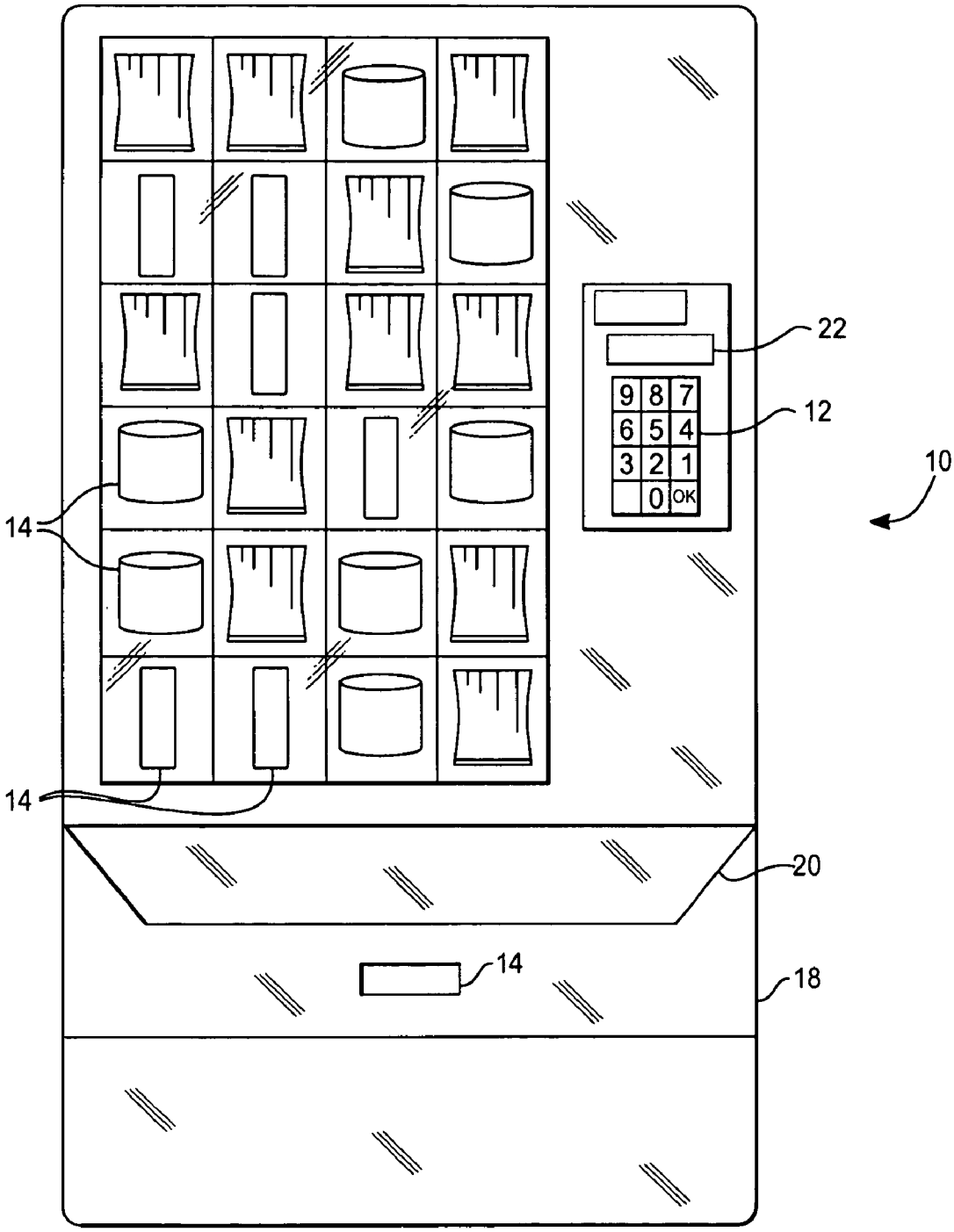
Fig. 1 (Prior Art)
FIG. 1 is a vending machine in the prior art.

In FIG. 1, a typical vending machine 10 contains a variety of products 14 arranged in various display racks 16. The customer requests a product 14 by placing money in the machine 22 and specifying the product 14, for instance by pressing the appropriate button on a display 12. Vending machines 10 may accept coins, paper money, credit cards, debit cards, or some other form of payment. The requested product 14 is generally dropped from its rack 16 (for instance by means of a spiral coil containing products which, when the product 14 is requested, is advanced a number of rotations sufficient to release the requested product 14 from the coil; other vending means are well-known in the art) and retrieved from a delivery area 18 in the vending machine 10, for instance by pushing open a door 20 on the delivery area 18.

Figure 2:
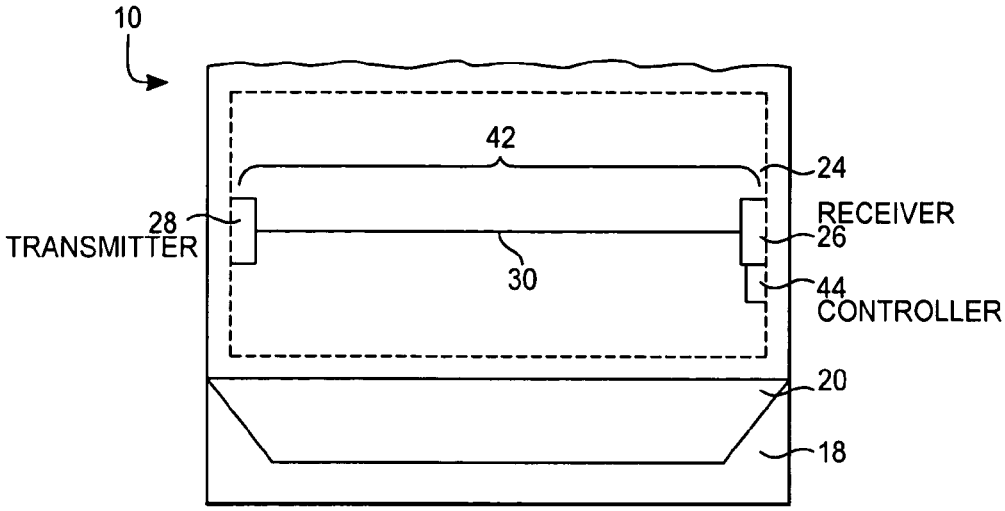
FIG. 2 shows one embodiment of a vending machine sensor to detect whether a product has been successfully vended.

FIG. 2 shows the vend area 24 and delivery area 18 of a vending machine 10. The vend area 24 is a defined area of the vending machine that features a sensor 42 to detect whether a product has been successfully vended. In this embodiment, the sensor 42 features a non-electromagnetic energy (for instance, sound or ultrasound) transmitter 28 which transmits continuous and measurable energy 30 to a receiver 26. (In other embodiments, the sensor 42 can detect mass-in-motion or momentum caused by the falling product coming into contact with part of the sensor.) If a product dropped through the vend area 24, between the transmitter 28 and receiver 26, there would be a temporary reduction in the amount of energy 3*b* detected by the receiver 26. When the receiver 26 detects the reduction of energy 30 caused by a product passing through the vend area 24, a controller 44 in electrical connection with the receiver 26 signals that the product was successfully vended and the sensor 42 is reset. Resetting the sensor allows the vending machine to detect whether the next customer request for a product is successfully completed.

When the customer initially requests an order, the controller 44 tracks the amount of time that elapses from the time of the order. If a predetermined time interval, in this embodiment five seconds (in other embodiments, time intervals of any length may be set), which has been programmed into the controller passes before a signal indicating a successful vend, the controller initiates a procedure to remedy the failed transaction. In various embodiments, this procedure may include refunding the customer's money, crediting the customer's next transaction, or vending a similar product. Once the procedure to remedy the failed transaction has successfully concluded, the sensor 42 is reset.

Figure 3:
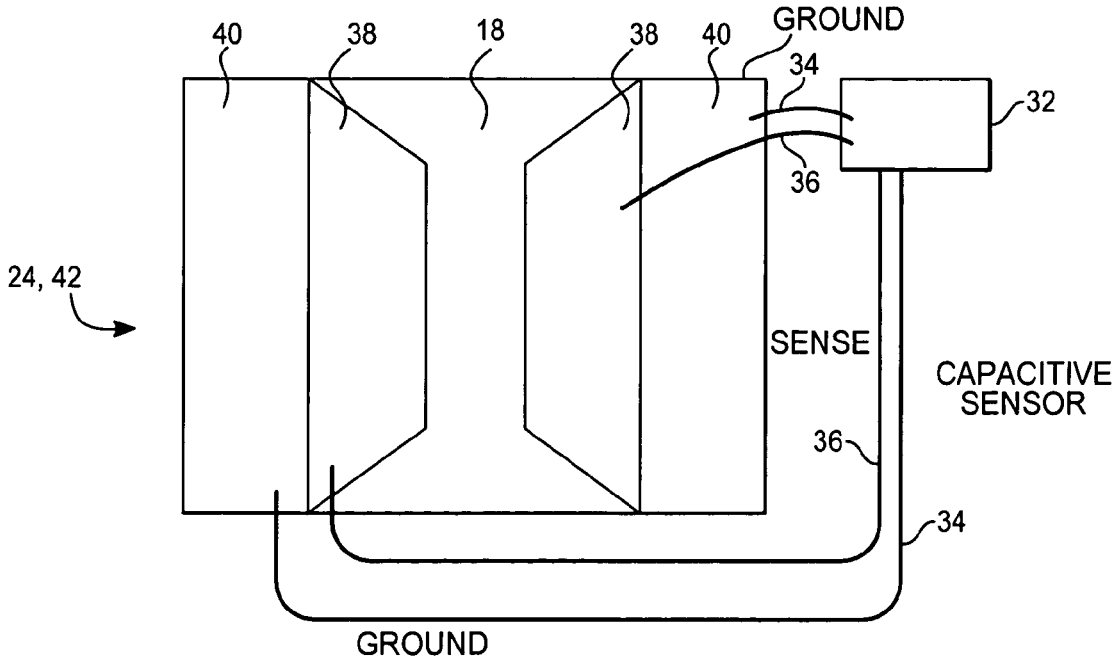
FIG. 3 shows an alternative embodiment of a vending machine sensor to detect whether a product has been successfully vended.

With reference to FIG. 3, in another embodiment of the invention, the sensor 42 detects changes in a capacitive field in the vend area 24 (which in this embodiment coincides with the sensor). The sensor 42 forms a chute, through which a requested product drops into the delivery area 18. In this embodiment, there are four panels 38, 40, each of which is attached to a controller 32. Two of the panels 40 are connected to ground 34 at the controller 32. The other two panels 40, which collapse to form the chute, connect to a capacitive sensor 36 at the controller 32. If the product comes into contact with the panels 40, the charge on the panels 40 is reduced or increased. This change in the field on the panels 40 may be detected at the controller 32, more particularly, the capacitive sensor 36. The detection event is run through a one-shot, which "holds" the event for a period of time (for instance, 2 seconds, although other periods of time may be set in other embodiments). As discussed above in FIG. 2, if a change in the field is detected, this indicates a successful vending transaction and the sensor 42 is reset, here after the 2 seconds during which the one-shot holds the event. However, if no change in the field is detected within the predetermined time interval, the controller 32 initiates the failed transaction procedure. Once this procedure is successfully completed, the sensor 42 is reset. In another embodiment, a magnetic field is generated; changes in the magnetic field caused by a product passing through the vend area 24.

The sensors described in FIGS. 2 and 3 detect changes in non-electromagnetic energy and capacitive and magnetic fields, respectively. In other embodiments, a change in ambient energy, such as light, in the vending area may indicate a successful vending transaction. If this approach is employed, a transmitter is not employed as in FIG. 2. Instead, only a receiver capable of detecting changes in ambient energy is used.

In other embodiments, a scanner that detects a Universal Product Code (UPC) on the product falling through the vend area may be employed. The scanner may either detect the actual UPC of the product or may register a "misread," indicating that a product having a UPC passed the sensor—in other words, a successful transaction may be indicated whether the scanner reads the actual UPC of the requested product or simply registers that a product, regardless of the UPC, passed the scanner. In another embodiment, a code, such as a UPC, is continuously read across the vend area. When the requested product passes through the vend area, it causes the code to be misread. This misread indicates a successful transaction.

Another embodiment uses a mechanical electrical switch that detects a falling product as it passes. When the product passes, it causes temporary conduction of electrical current through contacts, creating the signal to indicate a successful transaction.

In each of the alternative embodiments described above, if a successful transaction is not detected, a procedure to remedy a failed transaction is executed.

Figure 4:
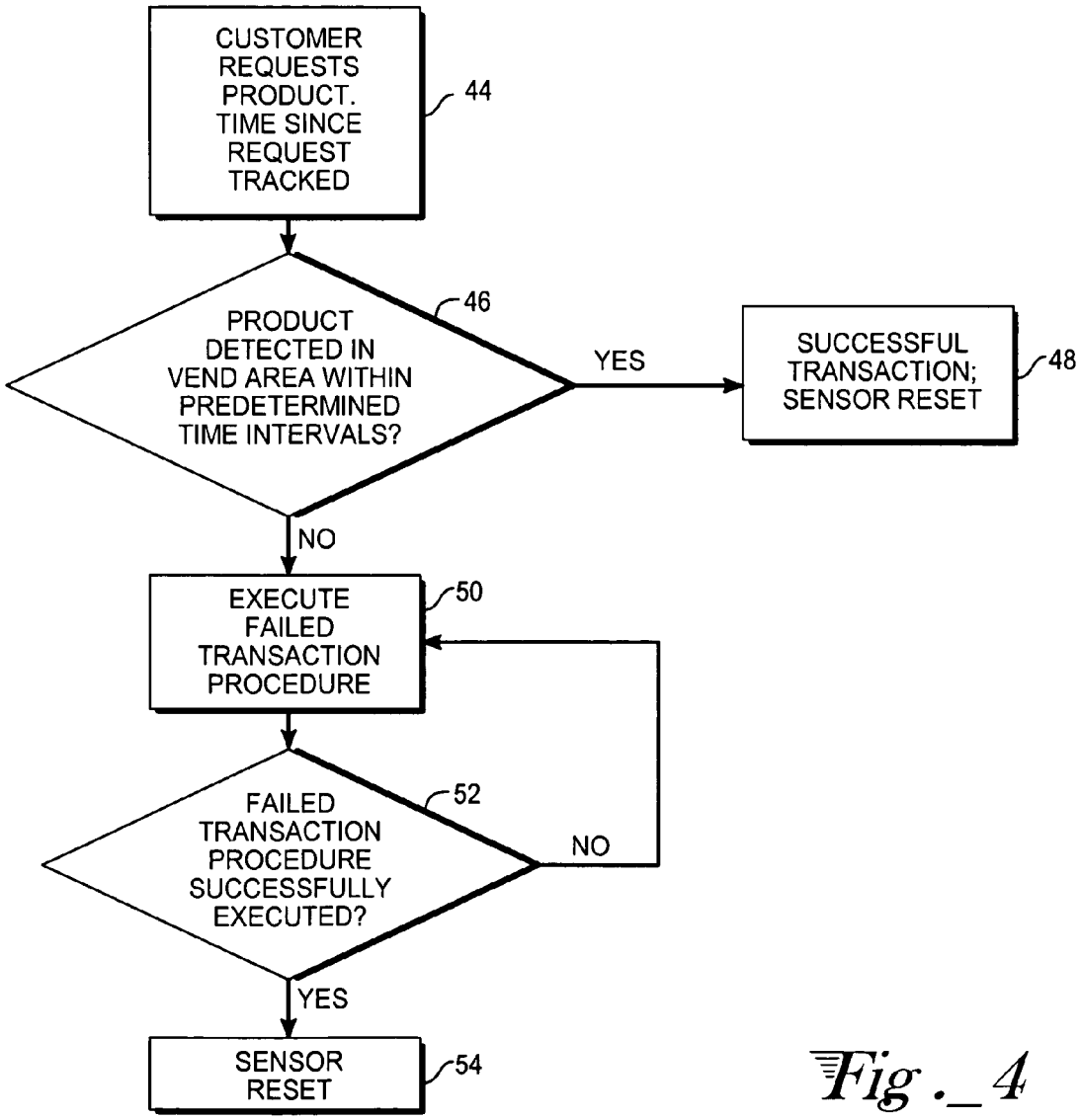
FIG. 4 is a flowchart of steps involved in determining whether a requested product has been successfully vended.

With reference to FIG. 4, the vending procedure starts when the customer requests a product from the vending machine (block 44). When the customer requests the product, the controller begins to track the time since the request (block 44). If the product is detected by the sensor within the vend area and within the predetermined time interval (block 46), a successful transaction is signaled and the sensor is reset, allowing the vending machine to detect whether the next customer request for a product is successfully completed (block 48).

If the product is not detected by the sensor within the vend area (block 46), the failed transaction procedure is executed (block 50). In various embodiments, the failed transaction procedure could involve refunding the customer's money, refunding the customer's next transaction, or vending a similar product to the customer. Once the failed transaction procedure is successfully executed (block 52), the sensor is reset (block 54).

What is claimed is:

1. A sensor for a vending machine to detect whether a requested product has been successfully vended comprising:

a) a detector for detecting a product passing through a defined area, the detector comprised of at a plurality of plates defining a chute, means for creating a charge differential between the plurality of plates and means for detecting a change in the charge on the plates resulting from a product passing through the chute;

ch) an indicator in electrical communication with the detector, the indicator signaling whether the detector has detected an object within the chute within a predetermined period of time, wherein detection of the object indicates the requested product was successfully vended.

2. The sensor of claim 1 further comprising means for resetting the detector after the predetermined period of time has elapsed.

3. The sensor of claim 1 further comprising means in electrical connection with the indicator for executing a procedure to respond to the customer's request when the requested product was not successfully vended.

4. A method for determining whether a product requested from a vending machine was successfully vended comprising:

a) receiving a request for a product from a customer;

b) determining whether the requested product has passed through a defined area of the vending machine within a predetermined amount of time since receiving the request, the defined area being defined by a plurality of plates, between which there is a charge differential; the determination made by detecting a change in the charge on the plates in the defined area; and c) signaling if the product did pass through the defined area within the predetermined amount of time, wherein the signal indicates that the product was vended successfully.

5. The method of claim 4 further comprising executing a procedure to respond to the customer's request where no signal is received.

6. The method of claim 5 wherein the procedure requires refunding the customer's money.

7. The method of claim 5 wherein the procedure requires crediting the customer's next transaction.

8. The method of claim 5 wherein the procedure requires vending a product similar to the one originally requested by the customer.

* * * * *